United States Patent [19]

Kowalik et al.

[11] 3,958,718

[45] May 25, 1976

[54] PULL TAB FOR NESTED TAB SAFETY CLOSURE

[75] Inventors: John J. Kowalik, Glenview; Gary K. Hasegawa, Morton Grove, both of Ill.

[73] Assignee: Continental Can Company, Inc., New York, N.Y.

[22] Filed: July 3, 1975

[21] Appl. No.: 593,410

[52] U.S. Cl. ..... 220/273

[51] Int. Cl.[2] ..... B65D 41/32

[58] Field of Search ..... 220/270–273

[56] References Cited

UNITED STATES PATENTS

| | | | |
|---|---|---|---|
| 3,715,051 | 2/1973 | Hanke | 220/273 |
| 3,880,318 | 4/1975 | Fraze | 220/273 |

*Primary Examiner*—George T. Hall

*Attorney, Agent, or Firm*—Paul J. Lerner; Joseph E. Kerwin; William A. Dittmann

[57] ABSTRACT

An improved pull tab for a child-resistant self-opening end closure of the type wherein the tab is nested between end panel protrusions which shield and obstruct access to the tab ring and prevent grasping and lifting of the tab and opening of the closure. The tab is formed with a short nose portion with a piercing member, and a bulged fulcrum which provide adequate clearance between the tab and the end panel to permit depressing the nose portion of the tab causing the ring portion to tilt upwardly to clear the shield and permit the ring to be grasped and pulled to open the container.

5 Claims, 3 Drawing Figures

PULL TAB FOR NESTED TAB SAFETY CLOSURE

SUMMARY OF THE INVENTION

The present invention pertains to child-resistant safety closures, and more particularly, to child-resistant closures for self-opening cans.

Child-resistant self-opening end closures, of the type wherein the pull tab is nested between end panel protrusions which obstruct access to the tab ring is shown in co-pending Applications Attorney's Docket J-1068 - NESTED TAB SAFETY CLOSURE - and Docket J-1124 - END PANEL FOR NESTED TAB SAFETY CLOSURE - assigned to Continental Can Company, Inc., and filed concurrently herewith. End closures of the type shown may be subject to damage caused by accidental impact on the protruding, upturned nose portion of the tab. Such impacts could result in distortion of the tab and concomitant difficulties in opening the can, or in permanent displacement of the ring portion of the tab and resultant loss of the child-resistant feature of the closure.

It is, therefore, the primary object of the present invention to provide an improved pull tab for a nested tab safety closure, wherein the nose portion is configured to minimize the possibility of damage resulting from accidental impact thereon.

It is a further object to provide an improved pull tab that requires a minimum of material and a minimum of modification to existing pull tab tooling.

It is another object to provide an improved pull tab which may be employed in conjunction with an unmodified end panel of the tab-nesting type.

BRIEF DESCRIPTION OF THE DRAWINGS

The various features and advantages of the pull tab of this invention will be more apparent from the following detailed description when considered in connection with the accompanying drawing wherein.

DESCRIPTION OF THE PREFERRED EMBODIMENT

Figure 1:
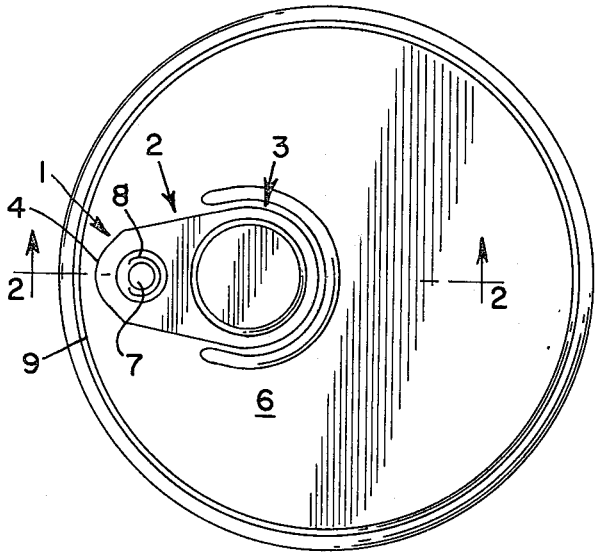
FIG. 1 is a top plan view of an end closure of the nested-tab type, having in association therewith the improved pull tab of the present invention.
Figure 2:
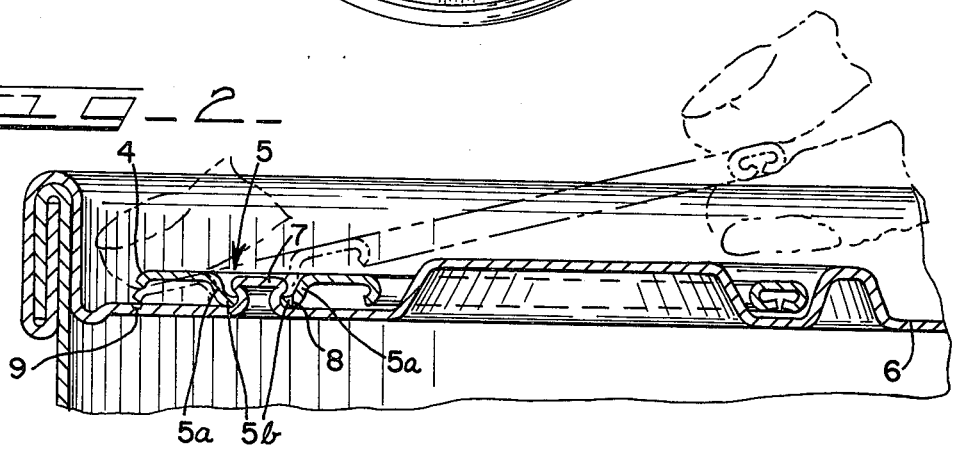
FIG. 2 is a fragmentary cross-sectional view taken substantially along line 1-1 of FIG. 1.
Figure 3:
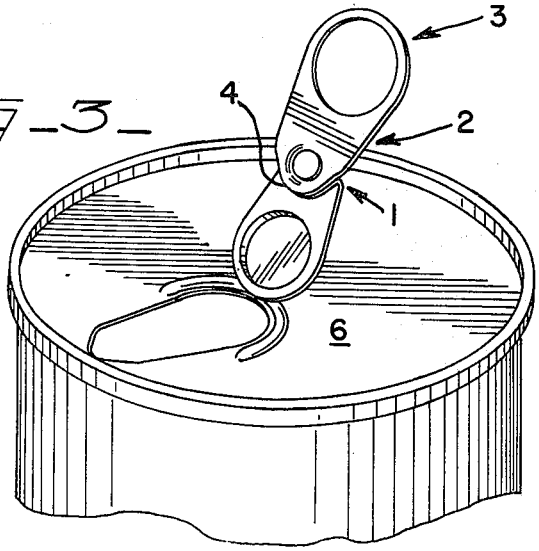
FIG. 3 is a fragmentary perspective view of the end closure in a partially opened condition.

As shown in the drawings, the pull tab of the present invention comprises a nose portion 1, an intermediate portion 2 and a substantially circular finger ring portion 3, said portions being substantially coplanar. An integral piercing member or opener 4 for fracturing the flap-defining score 9 is formed on the nose portion 1 and a recessed, substantially circular rivet well 5 is formed in the intermediate portion 2 and acts as a fulcrum accommodating tilting of the tab.

The rivet well 5 comprises a well wall **5*a* and a substantially flat, horizontal well base or flange 5*b*, which is substantially parallel to the principal plane of the tab. The pull tab is attached to the container end panel 6 by an integrally formed rivet 7 which passes through a hole in the well base 5*b* and holds the base 5*b* flat against the end panel 6. A horseshoe-shaped slit 8 is formed in the well base 5*b* concentric with the rivet 7, opening toward the nose portion 1 of the tab. The slit 8 permits the pull tab to be lifted without distortion of the end panel 6 in the area adjacent the rivet 7. The well wall 5*a* slopes outwardly from the well base 5*b* to provide sufficient clearance between the wall 5*a* and the head of the rivet 7** during lifting of the tab.

The piercing member 4 comprises a panelward curl on the distal edge of the nose portion 1 of the pull tab. In conventional pull tabs, a vertical member extends panelwardly from the free end of the curl, terminating near the flap-defining score 9. In the improved pull tab of the present invention, this vertical member is eliminated and the curl is formed such that the distance from the plane of the tab to the free edge of the curl is less than the distance from the plane of the tab to the well base **5*b*. By elimination of the vertical member of the piercing member 4 and provision of the well 5, the clearance between the end panel 6 and the nose portion 1 is maximized, allowing increased panelward displacement of the portion 1. Thus, by depressing the nose portion 1, the pull tab is tilted about the point 10 on the well base 5*b* nearest the periphery of the end panel 6. This tilting results in displacement of the handle portion 3** to a position whereat it may be grasped and the container opened.

Thus, a simplified and improved structure is obtained which obviates the possibility of accidental displacement of the nose portion 1 and attendant lifting of the ring 3 out of the shield structure.

We claim:

1. An improved pull tab for use in a child-resistant safety closure of the type wherein the tab is mounted flat against the end panel and shield means on said end panel obstruct grasping of said tab, said tab comprising a nose portion, an intermediate portion and a handle portion, said portions being substantially coplanar, said end panel having a score defining an opening flap therein and said nose portion having means for fracturing said score to open said flap, said shield means comprising at least one raised protrusion formed in said end panel, said one protrusion being outside said tab and completely surrounding the periphery of said handle portion, fulcrum means on said intermediate portion accommodating tilting said tab relative to said end panel and tilt enhancing means on said nose portion, said fulcrum means comprising a rivet well, including a sidewall and a base, said tab being rockably attached to said end panel, said tilt-enhancing means comprising said fracturing means formed as a panelward curl on the edge of said nose portion to provide clearance between said tab and said end panel, both of said means cooperating whereby panelward displacement of said nose portion tilts said tab about said fulcrum, displacing said handle portion away from said shield means to a position whereat it may be grasped, said base of said well being substantially flat and substantially parallel to the principal plane of said tab and sitting in close contact with said end panel.

2. The invention of claim 1, wherein said sidewall of said bulge slopes outwardly from said base.

3. The invention of claim 2, wherein a horseshoe-shaped slit is formed in said base of said bulge, concentric with said rivet and opening toward said nose portion of said tab.

4. The invention of claim 3, wherein said tab is formed of metal.

5. The invention of claim 3, wherein said nose portion is offset above the panel to provide space for tilting of said nose portion panelwardly.

* * * * *